US009382039B2

(12) United States Patent
Foley

(10) Patent No.: US 9,382,039 B2
(45) Date of Patent: Jul. 5, 2016

(54) FOOD CUP PACKAGING ASSEMBLY

(71) Applicant: Kellogg Company, Battle Creek, MI (US)

(72) Inventor: Edward J Foley, Richland, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 14/568,158

(22) Filed: Dec. 12, 2014

(65) Prior Publication Data

US 2015/0166240 A1 Jun. 18, 2015

Related U.S. Application Data

(60) Provisional application No. 61/917,020, filed on Dec. 17, 2013.

(51) Int. Cl.

| | |
|---|---|
| ***B65D 75/00*** | (2006.01) |
| ***B65D 21/02*** | (2006.01) |
| ***B65D 71/46*** | (2006.01) |
| ***B65D 51/28*** | (2006.01) |

(52) U.S. Cl.

CPC ..... *B65D 21/0219* (2013.01); *B65D 51/28* (2013.01); *B65D 71/46* (2013.01)

(58) Field of Classification Search

CPC ..... B65D 2571/0066; B65D 21/0219; B65D 71/46; B65D 51/28; B65D 81/34; B65D 43/02; B65D 71/12; B65D 71/72

USPC ..... 206/434, 427, 196, 197; 229/87.08, 229/103.2; 220/737, 738, 739; 426/114, 426/112, 396, 120

See application file for complete search history.

(56) References Cited

U.S. PATENT DOCUMENTS

| | | | | |
|---|---|---|---|---|
| 2,853,186 | A | | 9/1958 | Holmberg |
| 2,996,180 | A | | 5/1961 | Bruce |
| 3,016,259 | A | * | 1/1962 | Lawrence ..... 294/87.2 |
| 3,123,213 | A | * | 3/1964 | Kulig ..... 206/158 |
| 3,166,190 | A | * | 1/1965 | Conrades ..... 206/196 |
| 3,454,156 | A | | 7/1969 | Chatten |
| 3,570,663 | A | * | 3/1971 | Cunningham et al. ..... 206/194 |
| 3,687,281 | A | | 8/1972 | Prot |
| 4,120,396 | A | | 10/1978 | Mascia et al. |
| 4,232,807 | A | | 11/1980 | Beier et al. |

(Continued)

OTHER PUBLICATIONS

International Search Report for PCT Application No. PCT/US2014/070506 mailed Apr. 3, 2015.

(Continued)

*Primary Examiner* — Jacob K Ackun
*Assistant Examiner* — Jenine Pagan
(74) *Attorney, Agent, or Firm* — Honigman Miller Schwartz and Cohn LLP; Kathryn D. Doyle, Esq.; Jonathan P. O'Brien

(57) ABSTRACT

A packaging assembly is provided and may include a first cup having a first end, a second end formed on an opposite end of the first cup from the first end, and an interior defined between the first end and the second end that receives food product, whereby the first end has an opening in communication with the interior. The packaging assembly may also include a wrap that extends around the first cup and a cap that is selectively attached to the first cup at the first end to close the opening. The cap and the second end may extend through respective apertures formed in the wrap.

23 Claims, 5 Drawing Sheets

(56) References Cited

U.S. PATENT DOCUMENTS

| | | | | |
|---|---|---|---|---|
| 4,467,918 | A | 8/1984 | Blot | |
| 4,703,856 | A * | 11/1987 | Chaussadas | 206/429 |
| 4,930,633 | A | 6/1990 | Gloyer | |
| 5,409,128 | A | 4/1995 | Mitchell | |
| 5,439,111 | A | 8/1995 | Broskow | |
| 5,755,324 | A | 5/1998 | Campbell | |
| 5,855,275 | A | 1/1999 | Hunter et al. | |
| 5,921,392 | A | 7/1999 | Davis | |
| 6,926,147 | B2 | 8/2005 | Holley, Jr. | |
| 6,988,614 | B2 * | 1/2006 | Hemingway et al. | 206/217 |
| 7,083,046 | B2 * | 8/2006 | Bakx | 206/434 |
| 7,726,483 | B2 | 6/2010 | Ramanujam et al. | |
| 8,061,519 | B2 | 11/2011 | Tagilone | |
| 8,083,061 | B2 | 12/2011 | Fogel et al. | |
| 8,118,190 | B2 | 2/2012 | Coonce | |
| 8,256,617 | B2 | 9/2012 | Gomes et al. | |
| 2002/0192338 | A1 * | 12/2002 | Ness et al. | 426/119 |
| 2008/0078824 | A1 * | 4/2008 | Spriegel et al. | 229/403 |
| 2009/0242444 | A1 * | 10/2009 | Lebras | B65D 71/14 206/427 |
| 2010/0176022 | A1 | 7/2010 | Furlong | |
| 2011/0174642 | A1 * | 7/2011 | Coon | 206/222 |

OTHER PUBLICATIONS

YoCrunch introduces yogurt with cereal; news release (online); dairy foods; Nov. 15, 2012 (retrieved on Feb. 23, 2015); retrieved from the Internet: URL: http://webcache.googleusercontent.com/search?q+cache:XwWy01DeJtUJ:www.dairyfoods.com/articles/89008-yocrunch-introduces-yogurt-with-cereal+&cd=2&hl=en&ct=clnk&gl=us.

Breyers New YoCrunch Fruit Parfait; win a free product coupon! Product coupon promotion (online); FSM Blogs; Aug. 19, 2010 (retrieved on Feb. 23, 2015); retrieved from the internet: URL: http://www.fsm-blogs.com/breyers-new-yocrunch-fruit-parfait-win-a-fre-product-coupon-10-winners-ends-82610/.

* cited by examiner

FOOD CUP PACKAGING ASSEMBLY

RELATED APPLICATIONS

This application claims the benefit of U.S. Provisional Patent Application Ser. No. 61/917,020, filed Dec. 17, 2013, the entire contents of which are hereby incorporated by reference.

FIELD

The present disclosure relates generally to a food cup packaging assembly and, more particularly, to a food cup packaging assembly that provides for easier stacking and storing of food products.

BACKGROUND

The use of cups to contain food such as, for example, yogurt, ice cream, juice, and cereal are well known. The cups typically are sealed with a gas impermeable membrane that can be peeled away when the food is to be accessed. These cups can also have caps that can be used to reseal the cups when desired.

Packaging material is commonly used to enclose the cup or to hold more than one cup. The packaging material typically encloses not only the sides of the cups but also the tops and bottoms. In some examples, the packaging material covers the top and the bottom, in others, the top only and in still others, the bottom only.

The problem with known food cup packaging is that the covered top and bottom, or the covered top or bottom creates an unstable surface for stacking product.

What is needed is a food cup packaging assembly that provides for easier stacking and storing of food products.

SUMMARY

A packaging assembly is provided and may include a first cup having a first end, a second end formed on an opposite end of the first cup from the first end, and an interior defined between the first end and the second end that receives food product, whereby the first end has an opening in communication with the interior. The packaging assembly may also include a wrap that extends around the first cup and a cap that is selectively attached to the first cup at the first end to close the opening. The cap and the second end may extend through respective apertures formed in the wrap.

In one configuration, the cap and the second end protrude from opposite sides of the wrap.

In the above configuration, the opposite sides are substantially parallel to one another.

In another configuration, the wrap is a paperboard wrap having a first aperture receiving the cap and a second aperture receiving the second end.

In the above configuration, the wrap includes a first wall having the first aperture formed therethough, a second wall having the second aperture formed therethrough, a third wall extending between the first wall and the second wall, and a fourth wall that opposes the third wall and extends between the first wall and the second wall.

In the above configuration, the first aperture extends partially into the third wall and the fourth wall.

In one configuration, the cap includes a protrusion that extends through the wrap.

In the above configuration, the protrusion includes an engagement feature that matingly receives a second end of a second cup.

In the above configuration, the engagement feature is a recess defined by walls of the protrusion, whereby the recess receives the second end of the second cup therein when the second cup is in engagement with the protrusion.

In the above configuration, the protrusion defines a compartment that receives food product and is sealed from the interior of the first cup.

In the above configuration, the compartment is sealed from the interior of the first cup regardless of whether the cap is attached to or removed from the first cup.

A packaging assembly is provided and may include a first cup having a first end, a second end formed on an opposite end of the first cup from the first end, and an interior defined between the first end and the second end that receives food product, whereby the first end has an opening in communication with the interior. The packaging assembly may additionally include a wrap having a first wall, a second wall formed substantially parallel to the first wall, a third wall extending between the first wall and the second wall, and a fourth wall opposing the third wall and extending between the first wall and the second wall. A cap may be selectively attached to the first cup at the first end to close the opening, whereby the cap extends through the first wall and the second end extends through the second wall.

In one configuration, the wrap is a paperboard wrap having a first aperture formed in the first wall that receives the cap and a second aperture formed in the second wall that receives the second end.

In the above configuration, the first aperture extends partially into the third wall and the fourth wall.

In the above configuration, the second aperture extends partially into the third wall and the fourth wall.

In the above configuration, the cap includes a lip that extends into the first aperture at the third wall and the fourth wall.

In another configuration, the cap includes a protrusion that extends through the wrap.

In the above configuration, the protrusion includes an engagement feature that matingly receives a second end of a second cup.

In the above configuration, the engagement feature is a recess defined by walls of the protrusion, whereby the recess receives the second end of the second cup therein when the second cup is in engagement with the protrusion.

In the above configuration, the protrusion defines a compartment that receives food product and is sealed from the interior of the first cup.

In the above configuration, the compartment is sealed from the interior of the first cup regardless of whether the cap is attached to or removed from the first cup.

These and other features and advantages of this disclosure will become more apparent to those skilled in the art from the detailed description. The drawings that accompany the detailed description are described below.

DETAILED DESCRIPTION

Figure 1:
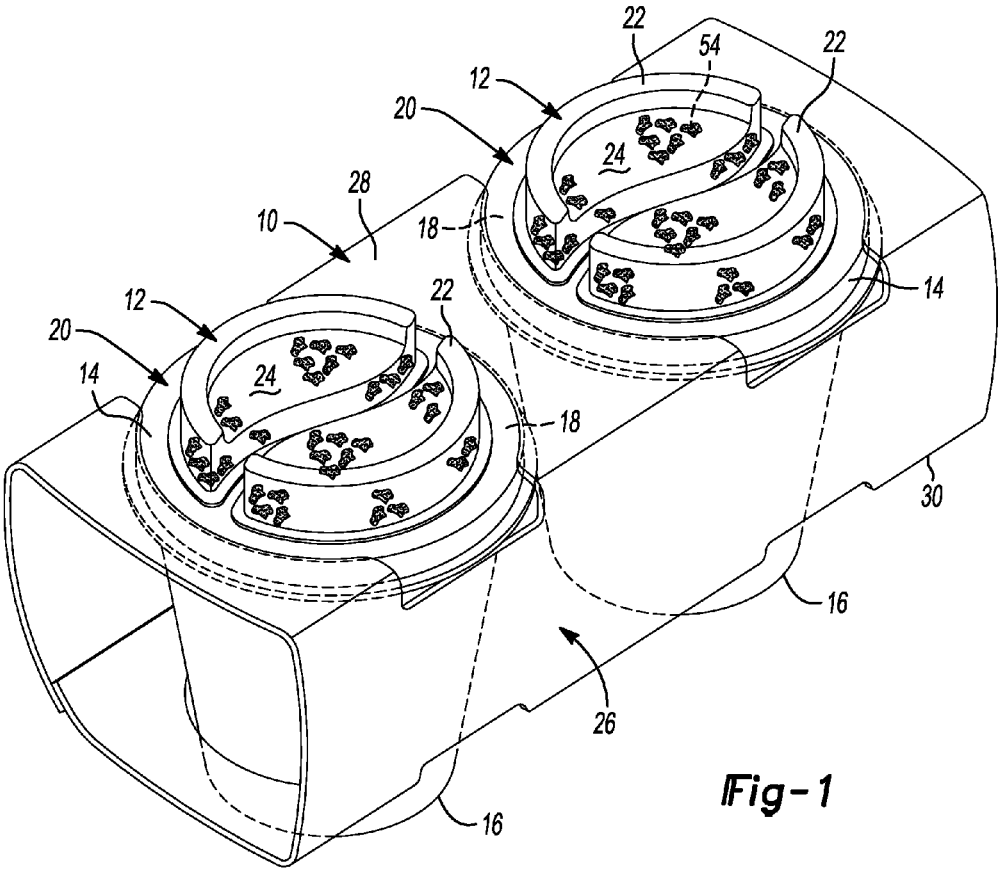
FIG. 1 is a perspective view of the food cup packaging assembly of the present disclosure.
Figure 7:
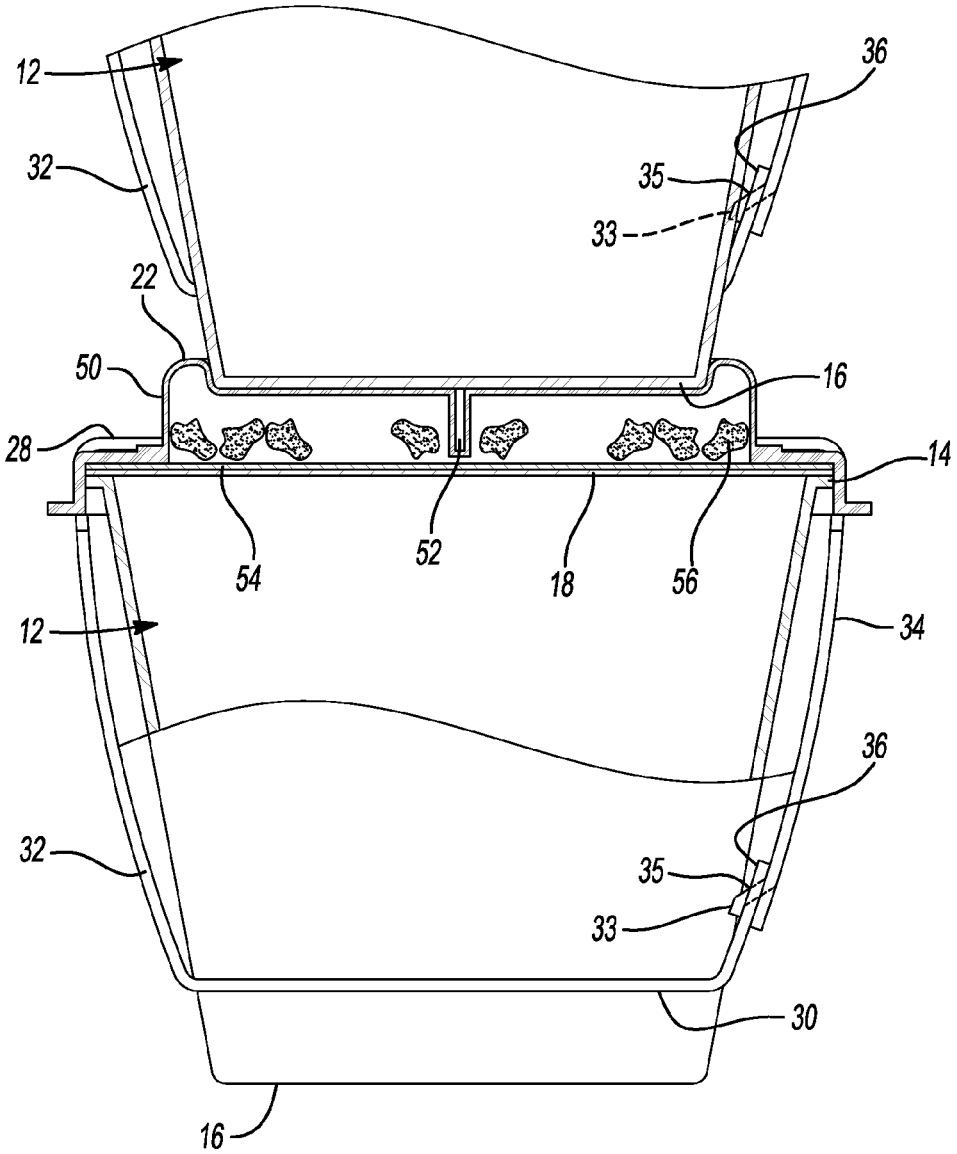
FIG. 7 is a partial cross-sectional view of the pair of food cup packaging assemblies of FIG. 6 taken along line 7-7.

The cup packaging assembly of the present disclosure is shown generally at 10 in FIG. 1. The cup packaging assembly 10 includes a pair of food cups 12 of generally cylindrical shape having a top 14 and a bottom 16. In the disclosed configuration, the top 14 is larger than the bottom 16. Also, in the disclosed configuration, the top 14 is open and the bottom 16 is closed. In the disclosed, the top 14 is initially sealed with a removable gas impermeable seal 18 (FIG. 7).

The top 14 includes a cap 20 having an annular step 22 extending upwardly from and annularly about the cap 20 defining a recess 24 of generally circular shape for allowing the bottom 16 of one cup 12 to rest within the recess 24 of the cap 20. In other words, the bottoms 16 of the cups 12 can be stacked on and matingly received by the caps 20 of adjacent cups 12.

Figure 2:
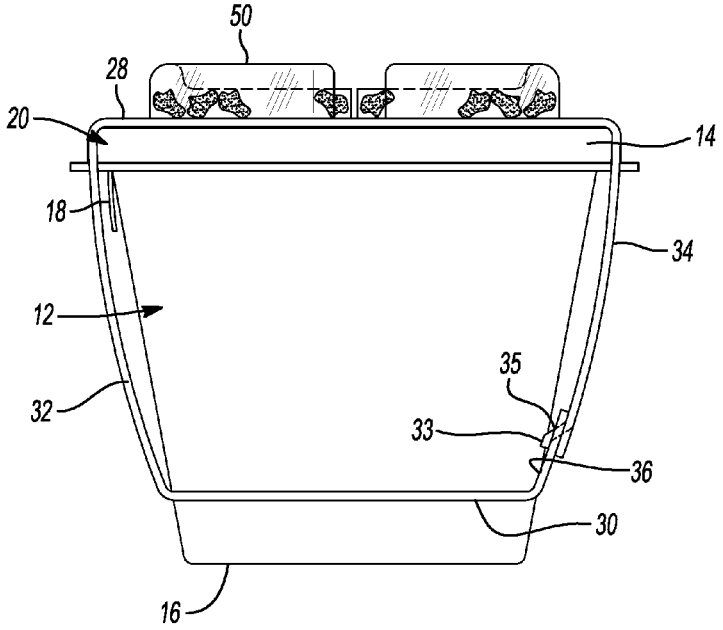
FIG. 2 is an end view of the food cup packaging assembly of the present disclosure.

With reference to FIG. 2, the food cup 12 is wrapped in a wrap or packaging 26, which in the disclosed configuration is paperboard, but could be for example plastic, aluminum or other materials. The packaging 26 has an upper portion 28 and a lower portion 30 that are substantially parallel to one another. Side portions 32 and 34 connect the upper portion 28 and the lower portion 30. A connector strip 36 connects the bottom 30 to the side 34 and may include one or more flaps 33 that are received within respective slots 35 to aid in attaching the bottom 30 to the side 34. The connector strip 36 may additionally or alternatively include a strip of adhesive to connect the bottom 30 to the side 34.

Figure 4:
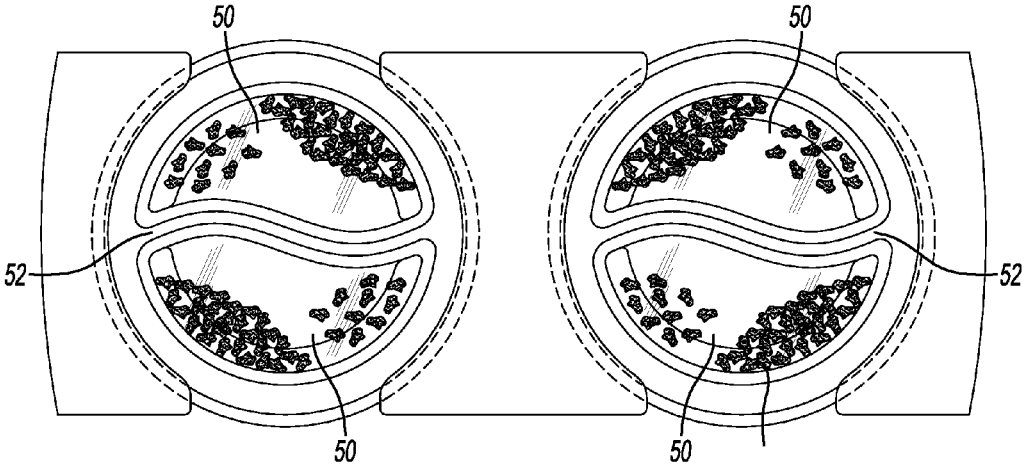
FIG. 4 is a top view of the packaging of the present disclosure.

With reference to FIG. 4, the packaging 26 is shown in a disassembled state with the bottom 30 being separated from the side 34 at the connector strip 36. As shown in FIG. 4, the upper portion 28 includes at least one first opening 38 and the lower portion 30 at least one second opening 40. In the disclosed configuration, there are two first openings 38 and two first openings 40. First and second cutouts 42 and 44 intersect each of the first openings 38 and third and fourth cutouts 46 and 48 intersect each of the second openings 40.

Figure 3:
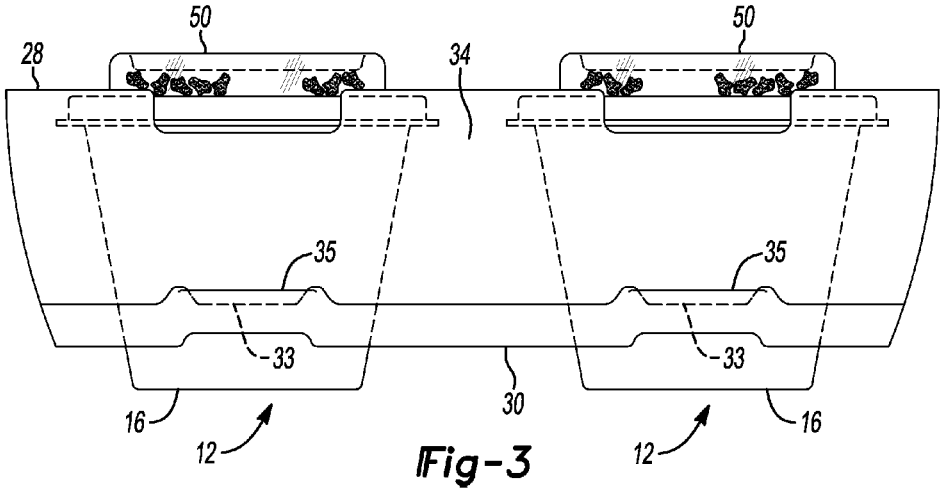
FIG. 3 is a side view of the food cup packaging assembly of the present disclosure.

The top 14 of the food cup 12 extends above the upper portion 28 of the paperboard packaging 26 and the bottom portion 30 of the food cup 12 extends below the lower portion 30 of the paperboard packaging 26. The cutouts 42, 44, 46 and 48 receive the sides of the cups 12 or a portion of the caps 20 to allow the cups 12 to be received and nest in the openings 38 and 40. For example, the cutouts 42, 44 may receive an annular lip of the caps 20 (FIGS. 2 and 3) while the cutouts 46, 48 receive a portion of the cups 12. As shown in FIG. 3, the cutouts 42, 44, 46, 48 respectively extend into the side portions 32, 34 to permit the cups 12 and/or caps 20 to nest therein. The exposed tops 14 and bottoms 16 protrude from the upper portion 28 and bottom portion 30, respectively. In this way, the tops 14 can receive the bottoms 16 of adjacent cups 12 (i.e., cups 12 associated with another, identical cup packaging assembly 10) so that they can be stacked on one another, as shown in FIGS. 6 and 7.

Figure 5:
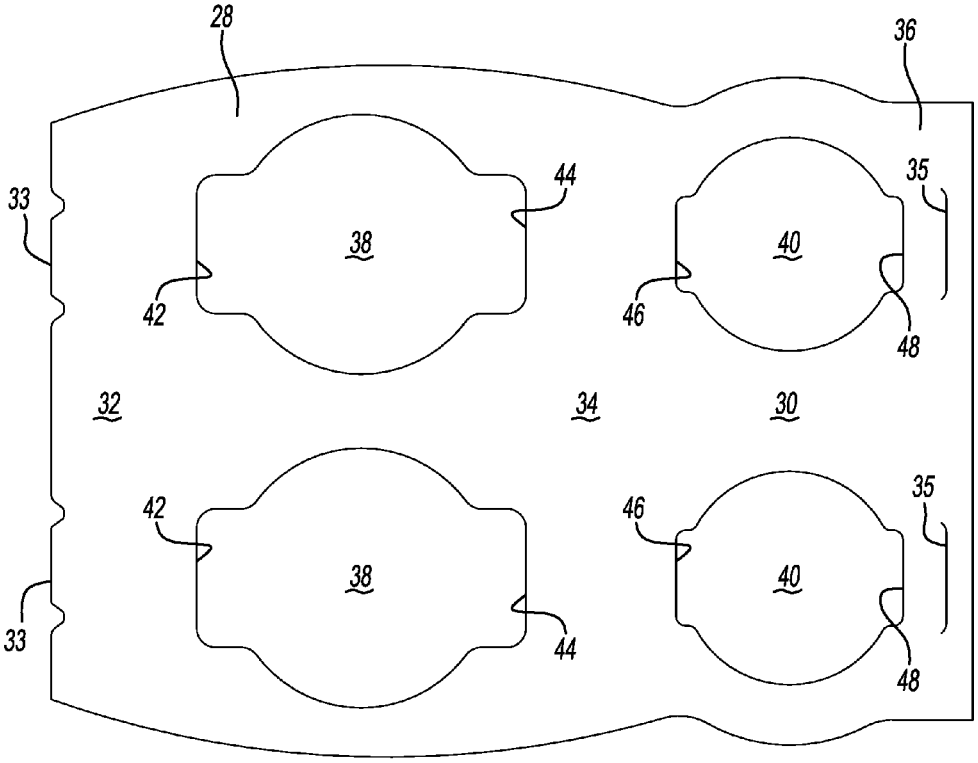
FIG. 5 is a top view of the food cup packaging assembly of the present disclosure.

With reference to FIG. 5, the cap 20 includes compartments 50. In the disclosed configuration, there are two separate compartments 50. As disclosed, the compartments 50 are separated by a groove 52. As further disclosed, the bottom of the cap 20 is sealed with a gas impermeable seal 54 (FIG. 7). As still further disclosed, the compartments 50 contain additives that can be added to the contents of the cup 12. The compartments 50 contain additives 56 (FIG. 7), such as for example, nuts, raisins, dried cherries, dried fruit, etc. These additives can be added to the contents of the cups 12 by removal of the seal 54.

The packaging 26 may contain more than one food cup 12. When there are two food cups 12, a first food cup 12 is disposed horizontally adjacent to, and spaced apart from, a second food cup 12 in the packaging 26, as shown in the drawings. The packaging 26 restricts lateral and up-and-down movement of the food cups 12.

Figure 6:
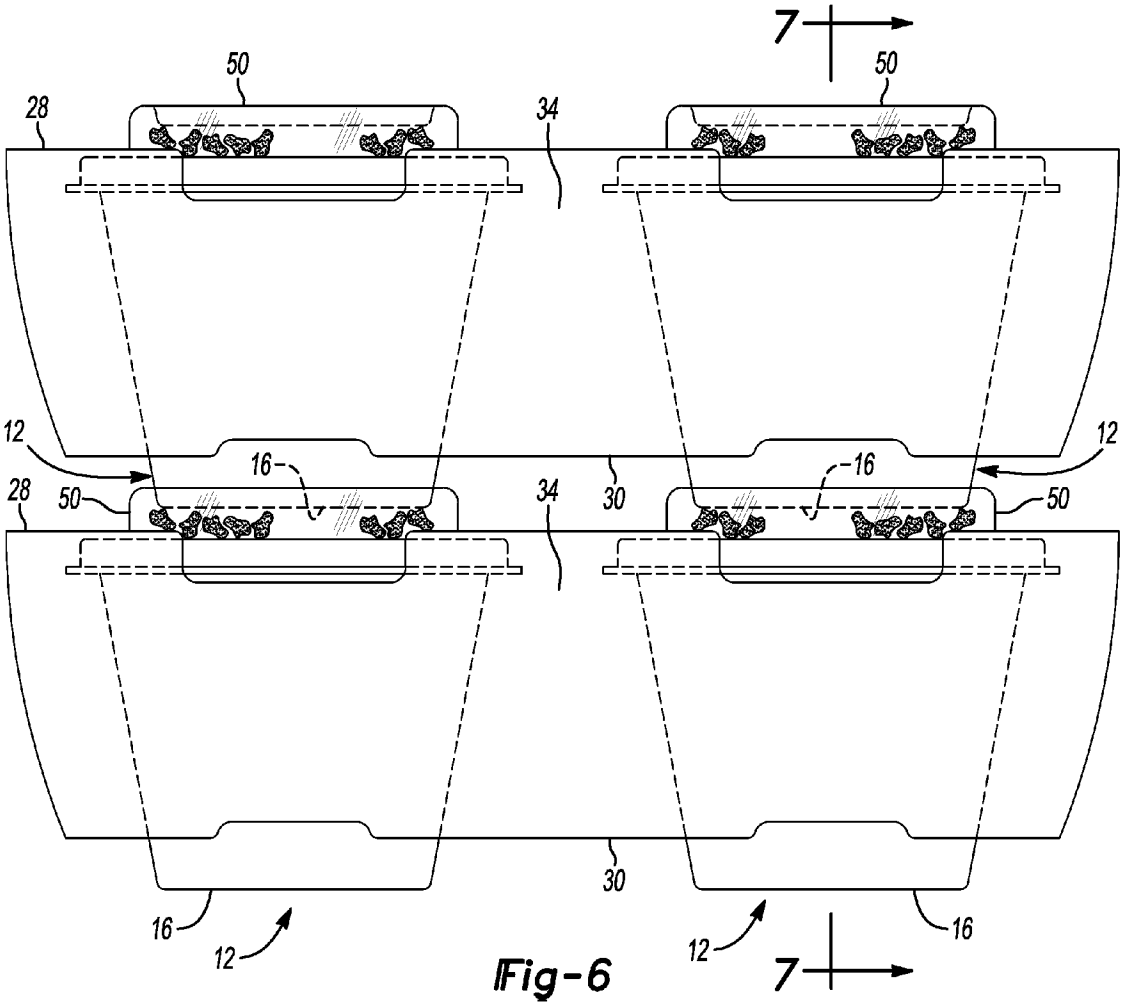
FIG. 6 is a side view of a pair of food cup packaging assemblies of the present disclosure showing one assembly stacked on the other assembly.

When the packaging 26 contains four food cups 12, a third food cup 12 is disposed on the first food cup 12 wherein the bottom 16 of the third food cup 12 engages the recess 24 of the top of the first food cup 12, as shown in FIGS. 6 and 7. A fourth food cup 12 is disposed on the second food cup 12, wherein the bottom 16 of the fourth food cup 12 engages the recess 24 of the top 14 of the second food cup 12. The food cups 12 are wrapped in the packaging 26 such that the top 14 of the third food cup 12 and the fourth food cup 12 extends above the upper portion 28 of the packaging 26 and the bottoms 30 of the first food cup 12 and second cup 12 extend below the lower portion 30 of the packaging 26. The packaging 26 can be used for more than four food cups 12, with the arrangement of the additional food cups 12 being similar to the arrangement of the third food cup 12 and fourth food cup 12 described above.

The food packaging assembly 10 is designed such that, while on a store shelf, during transportation, and when they reach the end consumer's home, the packaging 26 containing the food cups 12 can be stacked vertically adjacent by utilizing the nesting engagement. The food packaging assembly 10 allows the food cups 12 to be stacked vertically in any number of units, increases the stability of the packaging assembly 10 stacks, and creates more efficient storage options throughout the distribution chain.

The foregoing configurations have been described in accordance with the relevant legal standards, thus the description is exemplary rather than limiting in nature. Variations and modifications to the disclosed configuration may become apparent to those skilled in the art and do come within the scope of the disclosure. Accordingly, the scope of legal protection afforded this disclosure can only be determined by studying the following claims.

I claim:

1. A packaging assembly comprising:

a first cup having a first end, a second end formed on an opposite end of said first cup from said first end, and an interior defined between said first end and said second end that receives food product, said first end having an opening in communication with said interior;

a wrap that extends around said first cup; and a cap selectively attached to said first cup at said first end to close said opening, said cap extending through a first aperture formed in said wrap, said second end extending through a second aperture formed in said wrap, wherein said wrap includes a first wall having said first aperture formed therethrough, a second wall having said second aperture formed therethrough, a third wall extending between said first wall and said second wall, and a fourth wall that opposes said third wall and extends between said first wall and said second wall, said first aperture including a first cutout extending partially into said third wall and a second cutout extending partially into said fourth wall, said cap extending into said first and second cutouts; and wherein said cap includes a protrusion that extends through said wrap, said protrusion including an engagement feature operable to matingly receive a second end of a second cup.

2. The packaging assembly of claim 1, wherein said cap and said second end protrude from opposite sides of said wrap.

3. The packaging assembly of claim 2, wherein said opposite sides are substantially parallel to one another.

4. The packaging assembly of claim 1, wherein said wrap is a paperboard wrap.

5. The packaging assembly of claim 1, wherein said first aperture extends partially into said third wall and said fourth wall.

6. The packaging assembly of claim 1, wherein said engagement feature is a recess defined by walls of said protrusion, said recess receiving said second end of said second cup therein when said second cup is in engagement with said protrusion.

7. The packaging assembly of claim 1, wherein said protrusion defines a compartment that receives food product, said compartment sealed from said interior of said first cup.

8. The packaging assembly of claim 7, wherein said compartment is sealed from said interior of said first cup regardless of whether said cap is attached to or removed from said first cup.

9. The packaging assembly of claim 1, wherein said cap includes a storage compartment, said storage compartment being sealed from said interior of said cup by a first seal.

10. The packaging assembly of claim 9, wherein said storage compartment includes a first storage compartment and a second storage compartment.

11. The packaging assembly of claim 9, further comprising a second seal sealing said storage compartment, said second seal fixed for movement with said cap and said first seal fixed for movement with said cup.

12. The packaging assembly of claim 11, wherein said first seal opposes said second seal.

13. A packaging assembly comprising:

a first cup having a first end, a second end formed on an opposite end of said first cup from said first end, and an interior defined between said first end and said second end that receives food product, said first end having an opening in communication with said interior;

a wrap having a first wall including a first aperture formed therethrough, a second wall formed substantially parallel to said first wall and including a second aperture formed therethrough, a third wall extending between said first wall and said second wall, and a fourth wall opposing said third wall and extending between said first wall and said second wall, said first aperture including a first cutout extending partially into said third wall and a second cutout extending partially into said fourth wall; and a cap selectively attached to said first cup at said first end to close said opening, said cap extending into said first and second cutouts and said second end extending through said second wall;

wherein said cap includes a protrusion that extends through said wrap, said protrusion including an engagement feature operable to matingly receive a second end of a second cup.

14. The packaging assembly of claim 13, wherein said wrap is a paperboard wrap, and wherein said first aperture receives said cap and said second aperture receives said second end.

15. The packaging assembly of claim 14, wherein said second aperture extends partially into said third wall and said fourth wall.

16. The packaging assembly of claim 14, wherein said cap includes a lip that extends into said first aperture at said third wall and said fourth wall.

17. The packaging assembly of claim 13, wherein said engagement feature is a recess defined by walls of said protrusion, said recess receiving said second end of said second cup therein when said second cup is in engagement with said protrusion.

18. The packaging assembly of claim 13, wherein said protrusion defines a compartment that receives food product, said compartment sealed from said interior of said first cup.

19. The packaging assembly of claim 18, wherein said compartment is sealed from said interior of said first cup regardless of whether said cap is attached to or removed from said first cup.

20. The packaging assembly of claim 13, wherein said cap includes a storage compartment, said storage compartment being sealed from said interior of said cup by a first seal.

21. The packaging assembly of claim 20, wherein said storage compartment includes a first storage compartment and a second storage compartment.

22. The packaging assembly of claim 20, further comprising a second seal sealing said storage compartment, said second seal fixed for movement with said cap and said first seal fixed for movement with said cup.

23. The packaging assembly of claim 22, wherein said first seal opposes said second seal.

* * * * *